US007513380B2

(12) United States Patent
Canedo

(10) Patent No.: US 7,513,380 B2
(45) Date of Patent: Apr. 7, 2009

(54) SELF CLOSING CONTAINER

(76) Inventor: Robert Canedo, 901 W. Mulberry, San Antonio, TX (US) 78201

( * ) Notice: Subject to any disclaimer, the term of this patent is extended or adjusted under 35 U.S.C. 154(b) by 394 days.

(21) Appl. No.: 11/336,460

(22) Filed: Jan. 20, 2006

(65) Prior Publication Data

US 2007/0170184 A1 Jul. 26, 2007

(51) Int. Cl.
*B65D 51/00* (2006.01)

(52) U.S. Cl. ..... 220/230; 220/262; 220/264; 220/703; 220/254.9; 220/254.5

(58) Field of Classification Search ..... 220/254.9, 220/230, 264, 908, 254.5, 262, 703
See application file for complete search history.

(56) References Cited

U.S. PATENT DOCUMENTS

| | | | | | |
|---|---|---|---|---|---|
| 2,622,420 | A | * | 12/1952 | Rice | 215/309 |
| 3,967,748 | A | * | 7/1976 | Albert | 220/715 |
| 3,972,443 | A | * | 8/1976 | Albert | 220/715 |
| 4,057,167 | A | * | 11/1977 | Lee | 220/715 |
| 4,261,485 | A | * | 4/1981 | Borg | 222/500 |
| 4,276,992 | A | * | 7/1981 | Susich | 220/254.5 |
| 4,303,173 | A | * | 12/1981 | Nergard | 220/254.5 |
| 4,712,704 | A | * | 12/1987 | Ramsey et al. | 220/254.4 |
| 4,754,888 | A | | 7/1988 | Letsch | |
| 4,784,283 | A | * | 11/1988 | Cantu | 220/269 |
| 5,148,936 | A | * | 9/1992 | DeGrow | 220/254.3 |
| 5,186,353 | A | * | 2/1993 | Ramsey | 220/711 |
| 5,199,597 | A | * | 4/1993 | Gladish | 220/715 |
| 5,249,703 | A | | 10/1993 | Karp | |
| 5,294,014 | A | * | 3/1994 | Wyatt et al. | 220/253 |
| 5,363,745 | A | * | 11/1994 | Lin | 99/306 |
| 5,454,482 | A | | 10/1995 | Simon | |
| 5,706,972 | A | * | 1/1998 | Sousa | 220/714 |
| 5,918,761 | A | | 7/1999 | Wissinger | |
| 6,352,166 | B1 | * | 3/2002 | Copeland | 220/254.2 |
| 6,382,450 | B1 | | 5/2002 | De Rosa | |
| 6,659,302 | B2 | | 12/2003 | Lin | |
| 6,752,287 | B1 | * | 6/2004 | Lin | 220/254.9 |
| 6,763,964 | B1 | * | 7/2004 | Hurlbut et al. | 220/254.3 |
| 7,172,101 | B2 | * | 2/2007 | Find | 222/562 |
| 2005/0029265 | A1 | * | 2/2005 | Morgan et al. | 220/254.9 |

* cited by examiner

*Primary Examiner*—Anthony D Stashick
*Assistant Examiner*—Christopher B McKinley
(74) *Attorney, Agent, or Firm*—Ted D. Lee; Gunn, Lee & Cave, PC

(57) ABSTRACT

A self closing container having inner and outer sleeves. Outer sleeve surrounds inner sleeve and can freely slide on inner sleeve by lifting outer sleeve or handle. When container is closed, lid covers magnets, mouth magnets, mouth magnet platform, and mouth platform. When closed, bar magnet component is positioned over mouth magnets which permits mouth cover to cover mouth. When outer sleeve is raised, it raises ring in lid. In raised position, lid cover magnets on ring are repelled by corresponding magnets on lid cover. When ring is raised, mouth magnet platforms are raised. Mouth magnet platforms have two mouth magnets, one positioned toward mouth and one positioned toward back of the lid. When raised, mouth cover is moved backward to an open position with the use of the bar magnet component. When handle or outer sleeve is released all components return to their original positions effectively closing the container.

20 Claims, 5 Drawing Sheets

SELF CLOSING CONTAINER

BACKGROUND OF THE INVENTION

1. Field of the Invention

Applicant's invention relates to a self closing container for liquids which prevents the liquid from spilling when jolted and allows a person to drink from an otherwise closed container.

2. Background Information

Nowadays, it seems that everywhere you look someone is drinking out of a spill proof coffee mug or travel mug. The typical travel mug includes a container for holding the beverage fitted with a removable lid. The lid is generally provided with a mouth piece or opening through which the beverage may be removed by the user of the mug. This configuration allows considerable movement of the liquid within the mug without spilling because either the size of the opening in the lid or the mouth piece is such that it substantially confines the liquid. Recently developed travel mugs incorporate mouth covers over either the mouth opening or the mouth piece of the lid. The covers generally rest in a closed position over the mouth opening or mouth piece and are opened when the user depresses a button or other similar mechanism with his or her thumb. When the user releases the button or similar mechanism, the cover returns to its closed position over the mouth opening or mouth piece. The cover may or may not have a locking mechanism to prevent spills if the mug is dropped.

For a user with normal dexterity in his or her hands and fingers, it is quite simple to operate the typical travel mug. However, when a user lacks this normal dexterity, it is difficult to impossible for the user to operate the typical travel mug. Unfortunately, the prior art does not provide for a travel mug to be used by persons lacking normal dexterity in their hands and fingers. The present invention was designed for this purpose. While the present application shows a travel mug as the preferred embodiment, this invention has applicability to various types of containers.

SUMMARY OF THE INVENTION

The preferred embodiment of the present self closing container includes an inner sleeve which holds the contents of the container and an outer sleeve. The outer sleeve surrounds the upper part of the inner sleeve. Outer sleeve can freely slide on the inner sleeve by lifting a handle or grasping and lifting the outer sleeve itself. (When the lid is properly seated, the floating ring of the lid magnetically bonds to the top edge of the outer sleeve as it remains in the resting position.) The lid seals the container. Specifically, a stopper fits above inner sleeve while a rubber ring covers the gap formed between the inner sleeve and the outer sleeve. The floating ring is magnetically bonded to the top edge of the outer sleeve.

When the container is closed, the lid covers magnets, mouth magnets, mouth magnet platform, and mouth platform. In addition, in the closed position mouth cover covers mouth while the ends of its bar magnet component are positioned over the mouth magnets closest to the mouth. A locking mechanism is provided for extra spill prevention for mouth cover and as a means to optionally keep the container seated while it is carried.

When the handle or the outer sleeve is grasped and raised, the floating ring assembly is also raised. The floating ring assembly is magnetically bonded to the metallic upper portion of the outer sleeve via magnets affixed to its base. The magnets affixed to the base of the floating ring assembly are forcibly positioned into the proximity of corresponding magnets of opposite polarity extending through the openings of mouth platform. In addition, when floating ring is raised, mouth magnet platforms are raised. Mouth magnet platforms have two mouth magnets, one positioned toward mouth and one positioned toward the back of the lid. Also in this raised position mouth cover is moved backward to an open position with the use of the bar magnet component. When mouth magnets are raised, the magnetic field forces the bar magnet component back away from the mouth and toward the back of the lid. When the handle/outer sleeve is released, the opposite polarities of the lid and the ring magnets force the floating ring, its components and the mouth cover to their original positions.

DETAILED DESCRIPTION OF THE PREFERRED EMBODIMENT

Figure 1:
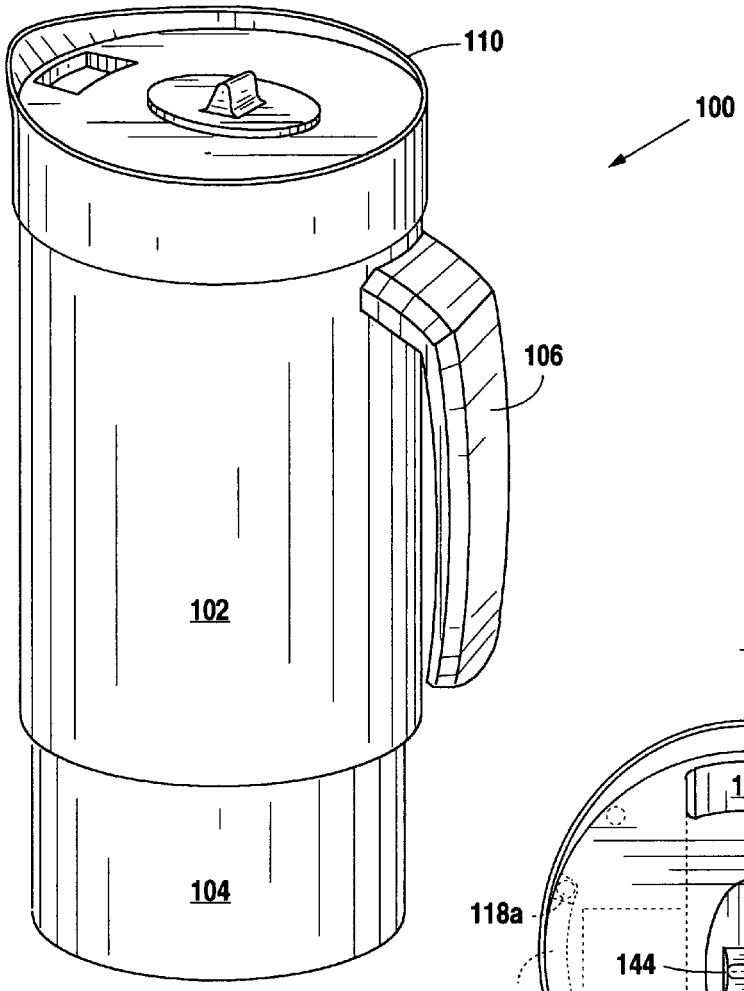
FIG. 1 is a perspective view of the preferred embodiment of the present invention.

In FIG. 1, a perspective view of the preferred embodiment of the present self-closing container 100 is shown. The self-closing container 100 has an inner sleeve 104 designed to hold the contents of the container 100. Self closing container 100 also has an outer sleeve 102. A handle 106 is provided on outer sleeve 102. Container 100 also includes a lid 110 shaped to be removably secured to outer sleeve 102 and inner sleeve 104 via the rubber ring 112. This is the primary means of securing the lid 110. Securing the lid 110 with screw threads (not shown) is a viable alternative.

Figure 2:
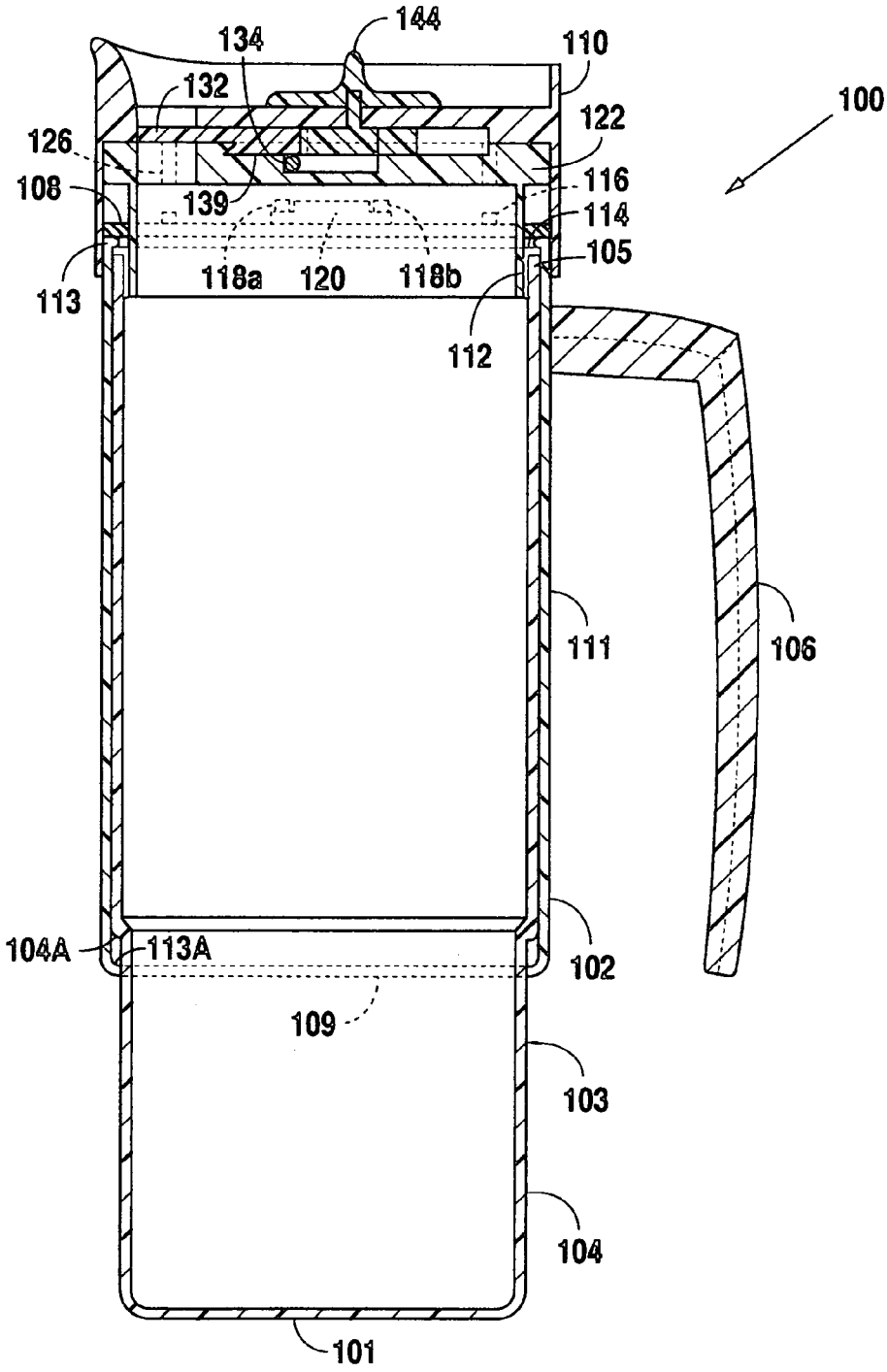
FIG. 2 is a side view of the preferred embodiment of the present invention with the lid closed.

FIG. 2 is a side view of the preferred embodiment of the present invention with the lid closed. The self closing container 100 has an inner sleeve 104 which is designed to hold the contents of the container 100. The inner sleeve 104 is composed of a bottom 101, continuous side wall 103 and edge 105. An opening is provided across the edge 105. Self closing container 100 also has an outer sleeve 102. The outer sleeve 102 is composed of an open base 109, continuous side wall 111, and edge 113. An opening is provided across the edge 113. A handle 106 is provided on the continuous side wall 111 of outer sleeve 102. Handle 106 can be of any general shape necessary to lift outer sleeve 102. Outer sleeve 102 surrounds the upper part of inner sleeve 104 and is designed to freely slide on the inner sleeve 104. Outer sleeve 102 can be moved vertically in relation to inner sleeve 104 by lifting outer sleeve 102 directly or by lifting the handle 106. Container 100 also includes a lid 110 shaped to be removably secured to edges 105 and 113, thereby enclosing openings at the tops of inner sleeve 104 and outer sleeve 102.

Lid 110 is shown removably secured to edges 105 and 113 thereby enclosing openings at the tops of inner sleeve 104 and outer sleeve 102. A stopper 114 fits above inner sleeve 104 while a rubber ring 112 covers the gap formed between the inner sleeve 104 and outer sleeve 102. Floating ring 108 bonds to outer sleeve 102. When the self-closing container 100 is closed, lid cover magnets 116, mouth magnets 118, mouth magnet platform 120, and mouth platform 122 are as shown. All magnets used in the preferred embodiment of the present invention are preferably neodymium rare earth magnets. Also in this closed position, mouth cover 132 covers mouth 130 (See FIG. 3) while the ends of bar magnet component 134 are positioned over the mouth magnets 118 closest to the mouth 130 (See FIG. 3). A locking mechanism 144 is provided on lid 110.

Figure 3:
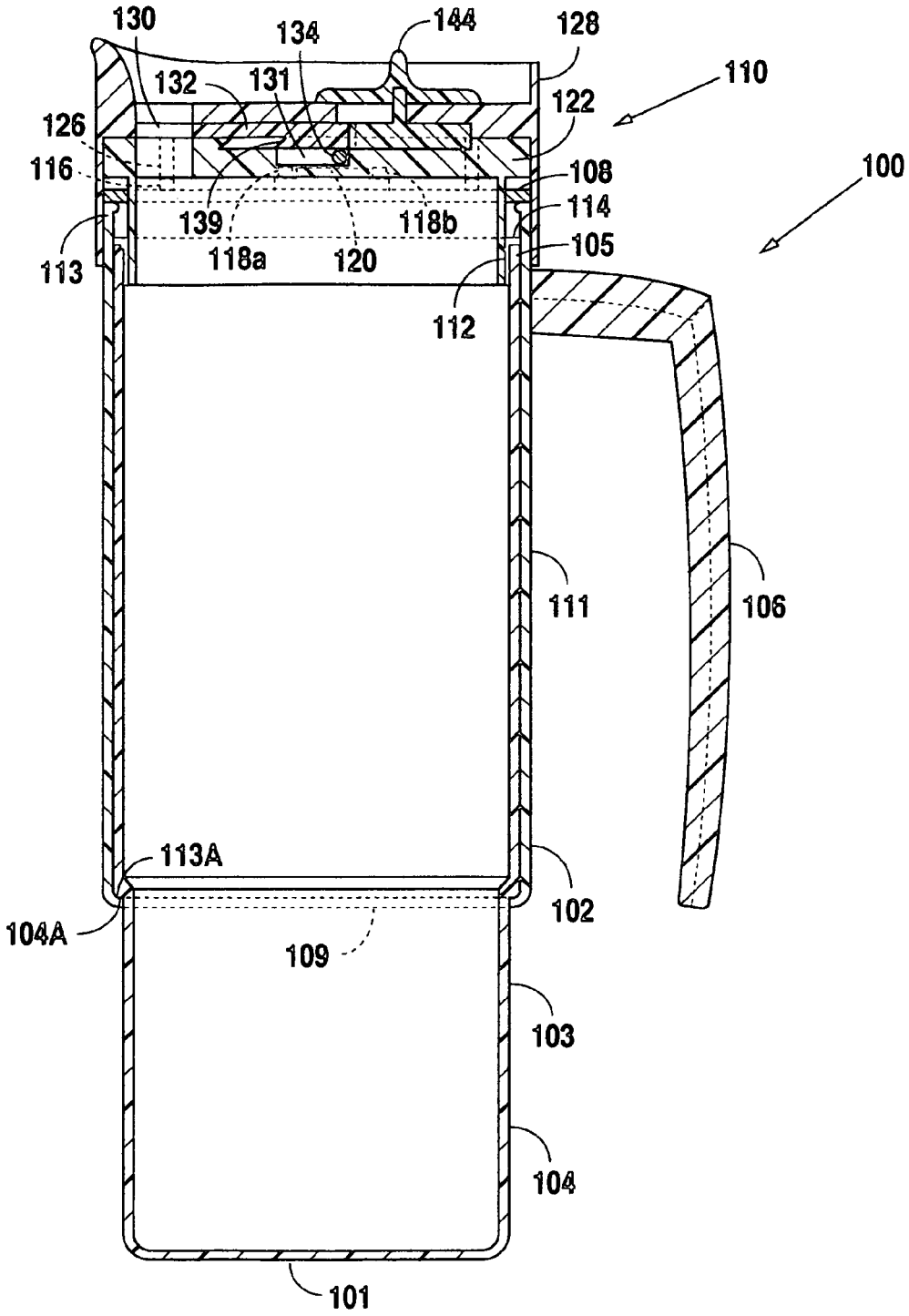
FIG. 3 is a side view of the preferred embodiment of the present invention with the lid open.

In FIG. 3, a side view of the preferred embodiment of the present invention with the lid 110 open is shown. The self closing container 100 has inner sleeve 104 which is composed of a bottom 101, continuous side wall 103 and edge 105. An opening is provided across the edge 105. Self closing container 100 also has outer sleeve 102 which is composed of an open base 109, continuous side wall 111, and edge 113. An opening is provided across the edge 113. Handle 106 is provided on the continuous side wall 111 of outer sleeve 102. Handle 106 can be of any general shape necessary to lift outer sleeve 102. Outer sleeve 102 surrounds the upper part of inner sleeve 104 and is designed to freely slide on the inner sleeve 104. Outer sleeve 102 can be moved vertically in relation to inner sleeve 104 by lifting the handle 106 or outer sleeve 102. Container 100 also includes a lid 110 shaped to be removably secured to edges 105 and 113 to enclose openings at the tops of inner sleeve 104 and outer sleeve 102.

Lid 110 is shown removably secured to edges 105 and 113 thereby enclosing openings at the tops of inner sleeve 104 and outer sleeve 102. Stopper 114 fits above inner sleeve 104. A locking mechanism 144 is provided on lid 110. When a user operates the self closing container 100 of the present invention, the user will begin with the container 100 in a closed position (See FIG. 2) and reach for the handle 106 or outer sleeve 102. Outer sleeve 102 can freely slide upward on the inner sleeve 104 by lifting the handle 106 or outer sleeve 102. When outer sleeve 102 is moved upward, it raises floating ring 108 of lid 110. In the raised position, lid cover magnets 116 on floating ring 108 are positioned closer to upper lid cover magnets 126 on lid cover 128. This increases the repulsive magnetic force between floating ring 108 and lid cover 128 that causes floating ring 108 to spring back into the resting position when the container 100 is released or dropped. In addition, when floating ring 108 is engaged and raised, two mouth magnet platforms 120 are raised on opposing sides of lid 110 orthogonal to mouth 130. Each of the mouth magnet platforms 120 has two mouth magnets 118, two positioned toward mouth 130 (118*a*) and two positioned toward the back of lid 110 (118*b*). Also in this raised position mouth cover 132 is moved backward to an open position with the use of the bar magnet component 134. When mouth magnets 118 are raised, the magnetic field forces the bar magnet component 134 back away from the mouth 130. When the user releases the handle 106 (See FIG. 1) or outer sleeve 102 (See FIG. 1) of container 100 (See FIG. 1), the outer sleeve 102 (See FIG. 1) returns to its resting position in conjunction with floating ring 108. Accordingly, mouth magnet platforms 120 along with the mouth magnets 118 return to their resting positions. When the mouth magnets 118 are returned to their resting positions, the bar magnet component 134 is drawn back to its resting position permitting the mouth cover 132 to return to cover mouth 130 (See FIG. 2).

Figure 4:
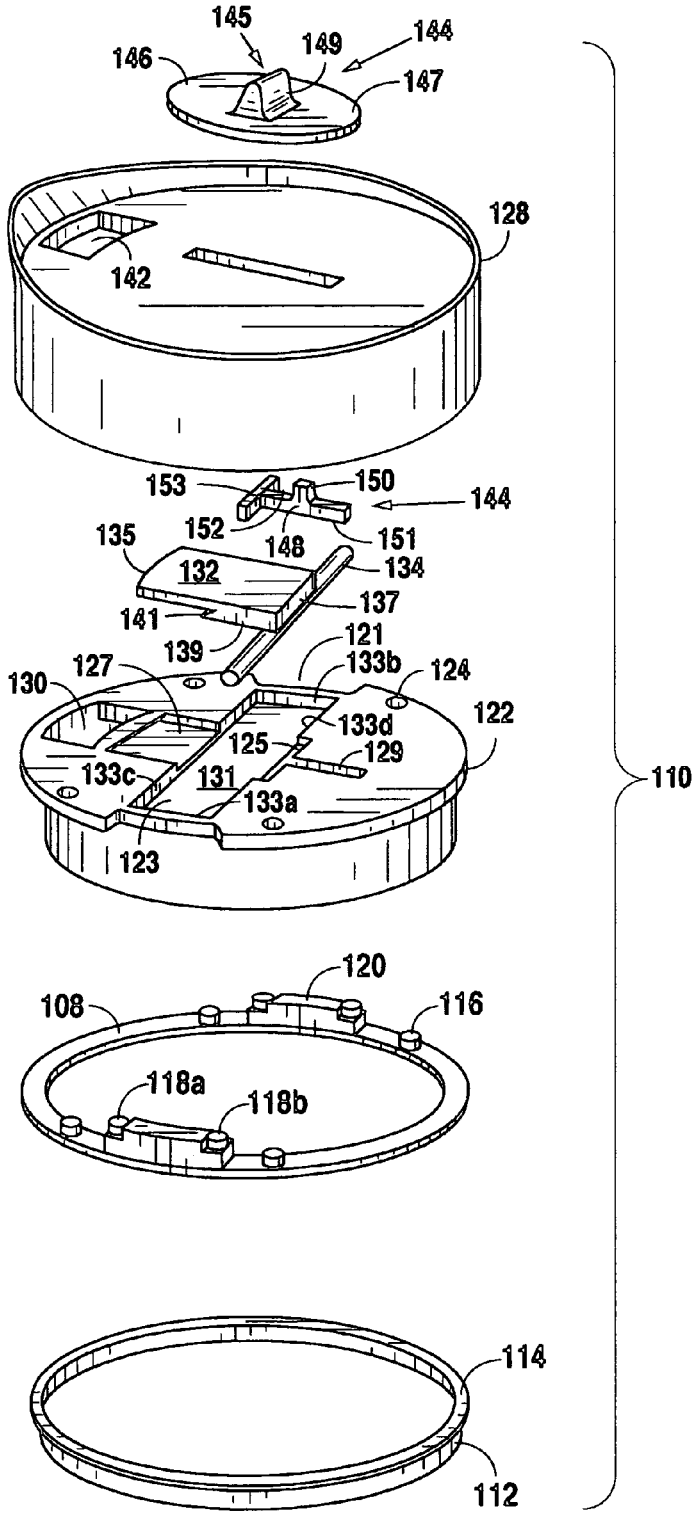
FIG. 4 is a first exploded view of the lid of the preferred embodiment of the present invention.

In FIG. 4, a first exploded view of the lid 110 of the preferred embodiment of the present invention is shown. Lid 110 is shaped to be removably secured to edges 105 (See FIG. 2) and 113 (See FIG. 2), thereby enclosing openings in inner sleeve 104 (See FIG. 2) and outer sleeve 102 (See FIG. 2). A stopper 114 fits above inner sleeve 104 (See FIG. 2) while a rubber ring 112 covers the gap formed between the inner sleeve 104 (See FIG. 2) and outer sleeve 102 (See FIG. 2). Floating ring 108 is provided to be positioned on outer sleeve 102 (See FIG. 2). A series of magnets are positioned on floating ring 108. A plurality of lid cover magnets 116, preferably four, are provided on the upper surface of floating ring 108. Lid cover magnets 116 are designed and positioned to hold the floating ring 108 securely to the outer sleeve 102. Positioned on the upper surface of floating ring 108 and on opposing sides of the floating ring 108 are preferably two mouth magnet platforms 120. Each mouth magnet platform 120 has two mouth magnets 118*a* and 118*b*, mouth magnets 118*a* positioned toward mouth 130 and mouth magnets 118*b* positioned toward the back of lid 110.

Positioned above floating ring 108 is mouth platform 122. Mouth platform 122 has preferably two mouth magnet platform openings 121, continuous therethrough, designed and positioned to accept the preferably two mouth magnet platforms 120 of floating ring 108. Lid cover magnet openings 124, continuous therethrough, are also provided designed and positioned to accept upper lid cover magnets 126. Bar magnet tract 123 is a partial opening centrally positioned within mouth platform 122. Bar magnet tract 123 is generally rectangular having a base 131, left side 133*a*, right side 133*b*, front 133*c* and back 133*d*. The bar magnet tract 123 provides a lock notch 125 toward the back of the lid 110 and a mouth cover tract 127 toward the mouth 130 of the lid 110. Lock notch 125 transitions into lock tract 129 while mouth cover tract 127 transitions into mouth 130. Mouth 130 is an opening provided to allow liquid to be removed from container 100.

Mouth cover 132 is provided over mouth platform 122 and is designed to cover mouth 130. Mouth cover 132 is composed of a tongue portion 135 and a base portion 137. Tongue portion 135 is designed to cover mouth 130 while base portion 137 holds bar magnet component 134. Mouth cover base 139 positioned underneath mouth cover 132 stabilizes bar magnet component 134. Mouth cover base 139 is generally rectangular but contains an angled front section 141. When self-closing container 100 (See FIG. 2) is in a closed position, mouth cover 132 is in place over mouth 130 while bar magnet component 134 is positioned within bar magnet tract 123 against the front 133*c*. Mouth cover base 139 is positioned within mouth cover tract 127. When self-closing container 100 (See FIG. 3) is in an opened positioned, mouth cover 132 is positioned over mouth cover tract 127 while mouth cover base 139 is positioned over bar magnet tract 123. Bar magnet component 134 is positioned within bar magnet tract 123 against the back 133*d*.

Positioned above mouth platform 122 is lid cover 128. Lid cover 128 has a lower bar magnet tract 143 (See FIG. 5) which is a partial opening centrally positioned within lid cover 128. Lower bar magnet tract 143 (See FIG. 5) is generally rectangular having a base 136 (See FIG. 5), left side 138*a* (See FIG. 5), right side 138*b* (See FIG. 5), front 138*c* (See FIG. 5) and back 138*d* (See FIG. 5). The lower bar magnet tract 143 (See FIG. 5) provides a lower lock notch 140 (See FIG. 5) toward the back of the lid cover 128. Lower lock notch 140 (See FIG. 5) transitions into a tower lock tract 141 (See FIG. 5). At the front of lid cover 128 is lid cover mouth 142 provided to allow liquid to be removed from container 100. Upper lid cover magnets 126 (See FIG. 5) are provided to repel lid cover magnets 116 on floating ring 108.

Figure 5:
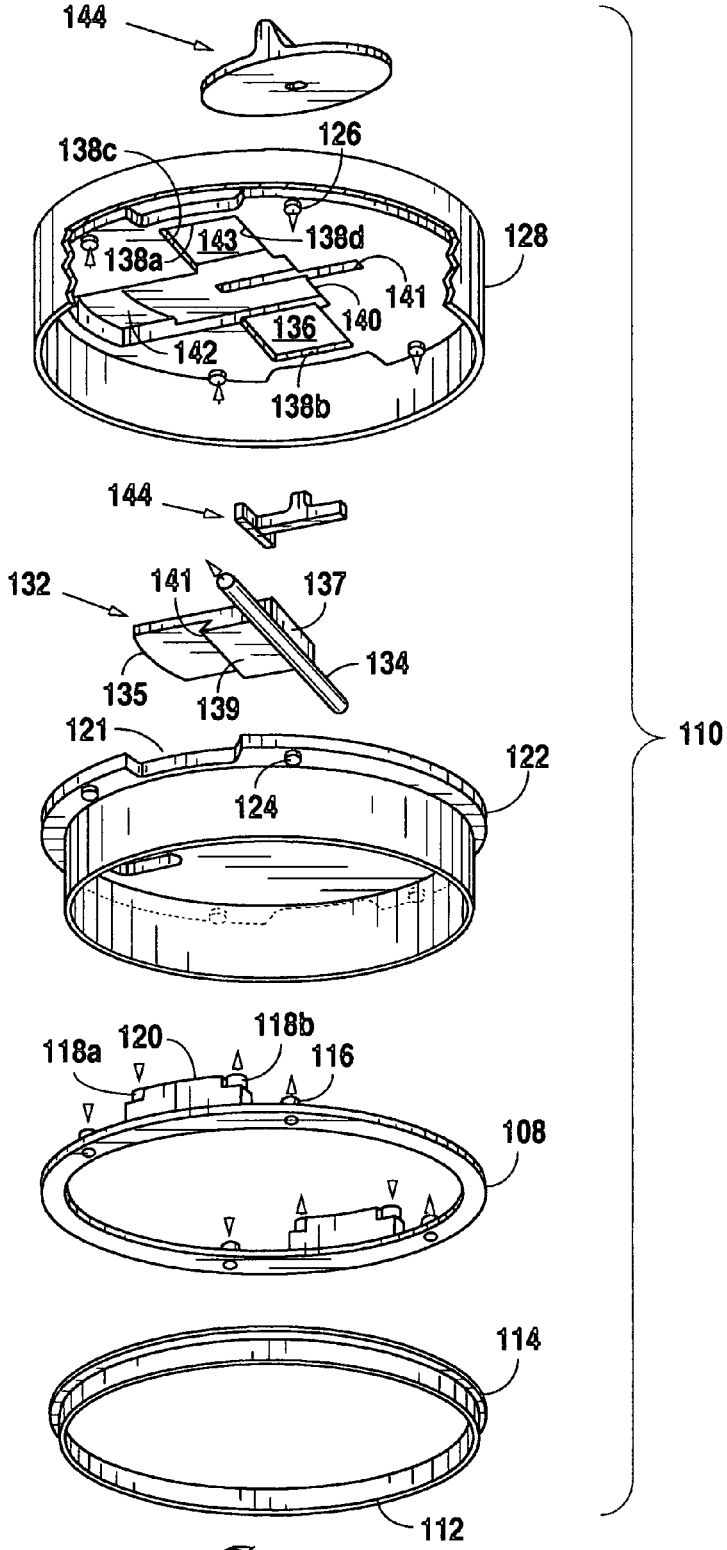
FIG. 5 is a second exploded view of the lid of the preferred embodiment of the present invention.

When self closing container 100 (See FIG. 2) is in a closed position, mouth cover 132 is in place under lid cover mouth 142 while bar magnet component 134 is positioned within lower bar magnet tract 143 (See FIG. 5) against the front 138*c* (See FIG. 5). Mouth cover base 139 is positioned completely within mouth cover tract 127. When self closing container 100 (See FIG. 3) is in an opened position, mouth cover 132 is positioned over mouth cover tract 127 while mouth cover base 139 is positioned under lower bar magnet tract 143 (See FIG. 5). Bar magnet component 134 is positioned within lower bar magnet tract 143 (See FIG. 5) against the back 138*d* (See FIG. 5).

Lock tract 129 of mouth platform 122 and lower lock tract 141 (See FIG. 5) of lid cover 128 within lid 110 are designed to accept the locking mechanism 144 of the present invention. Locking mechanism 144 is composed of a switch 145 having a front depression 146 and a rear depression 147. Switch 145 is positioned above lid cover 128. Positioned between the front depression 146 and rear depression 147 is raised portion 149. Switch 145 is partially hollowed to accommodate bar 148 which is positioned within lock tract 129 of mouth platform 122 and lower lock tract 141 (See FIG. 5) of lid cover 128. Contained within switch 145 is bar 148. The central portion 150 of bar 148 is designed and positioned to fit through lower lock tract 141 (See FIG. 5) into raised portion 149 of switch 145. Positioned to the rear of central portion 150 along bar 148 is rear portion 151 while positioned to the front of central portion 150 along bar 148 is front portion 152. Front portion 152 terminates in lock member 153.

FIG. 5 is a second exploded view of the lid of the preferred embodiment of the present invention. Lid 110 is shaped to be removably secured to edges 105 (See FIG. 2) and 113 (See FIG. 2), thereby enclosing openings in inner sleeve 104 (See FIG. 2) and outer sleeve 102 (See FIG. 2). A stopper 114 fits above inner sleeve 104 (See FIG. 2) while a rubber ring 112 covers the gap formed between the inner sleeve 104 (See FIG. 2) and outer sleeve 102 (See FIG. 2). Floating ring 108 is provided to be positioned on outer sleeve 102 (See FIG. 2). A series of magnets are positioned on floating ring 108. A plurality of lid cover magnets 116, preferably four, are provided on the upper surface of floating ring 108. Lid cover magnets 116 are designed and positioned to hold the floating ring 108 securely to the outer sleeve 102. Positioned on the upper surface of floating ring 108 and on opposing sides of the floating ring 108 are preferably two mouth magnet platforms 120. Each mouth magnet platform 120 has two mouth magnets 118*a* and 118*b*, mouth magnets 118*a* positioned toward mouth 130 and mouth magnets 118*b* positioned toward the back of lid 110.

Positioned above floating ring 108 is mouth platform 122. Mouth platform 122 has preferably two mouth magnet platform openings 121, continuous therethrough, designed and positioned to accept the preferably two mouth magnet platforms 120 of floating ring 108. Lid cover magnet openings 124, continuous therethrough, are also provided designed and positioned to accept upper lid cover magnets 126. Mouth 130 is provided.

Mouth cover 132 is provided over mouth platform 122 and is designed to cover mouth 130. Mouth cover 132 is composed of a tongue portion 135 and a base portion 137. Tongue portion 135 is designed to cover mouth 130 while base portion 137 holds bar magnet component 134. Mouth cover base 139 positioned underneath mouth cover 132 stabilizes bar magnet component 134. Mouth cover base 139 is generally rectangular but contains an angled front section 141.

Positioned above mouth platform 122 is lid cover 128. Lid cover 128 has a lower bar magnet tract 143 which is a partial opening centrally positioned within lid cover 128. Lower bar magnet tract 143 is generally rectangular having a base 136, left side 138*a*, right side 138*b*, front 138*c*, and back 138*d*. The lower bar magnet tract 143 provides a lower lock notch 140 toward the back of the lid cover 128. Lower lock notch 140 transitions into a lower lock tract 141. At the front of lid cover 128 is lid cover mouth 142 provided to allow liquid to be removed from container 100. Upper lid cover magnets 126 are provided to repel lid cover magnets 116 on floating ring 108.

When self-closing container 100 (See FIG. 2) is in a closed position, mouth cover 132 is in place over mouth 130 and under lid cover mouth 142 while bar magnet component 134 is positioned within lower bar magnet tract 143 against the front 138*c* and bar magnet tract 123 (See FIG. 4) against the front 133*c* (See FIG. 4). Mouth cover base 139 is positioned completely within mouth cover tract 127 (See FIG. 4). When the container 100 (See FIG. 2) is closed it may be desirable to lock the container 100 (See FIG. 2) in this closed position to keep the container 100 closed while being carried from one place to another and resist spills if the container 100 (See FIG. 2) is dropped. White the container 100 is designed to close if dropped regardless of the addition of locking mechanism 144 the locking mechanism 144 does provide additional spill protection.

In order to lock the container 100 (See FIG. 2), the user applies his or her finger to the rear depression 147 (See FIG. 4) and slides the switch 145 (See FIG. 4) toward the mouth 130 of the container 100 (See FIG. 2). Lock member 153 (See FIG. 4) will engage bar magnet component 134 and prevent bar magnet component 134 from moving mouth cover 132 into an opened position. In order to release the locking mechanism 144, the user applies his or her finger to the front depression 146 (See FIG. 4) and slides the switch 145 (See FIG. 4) away from the mouth 130 of the container 100 (See FIG. 2). Lock member 153 (See FIG. 4) will be removed from bar magnet component 134 permitting bar magnet component 134 to move mouth cover 132 into an opened position.

When a user operates the self closing container 100 of the present invention, the user will reach for and take the handle 106 (See FIG. 1) or outer sleeve 102 (See FIG. 1). Outer sleeve 102 (See FIG. 1) can freely slide upward on the inner sleeve 104 (See FIG. 1) by lifting the handle 106 (See FIG. 1) or outer sleeve 102 (See FIG. 1). When outer sleeve 102 (See FIG. 1) is moved upward outer sleeve 102 (See FIG. 1) lifts the floating ring 108 of lid 110. In the raised position, lid cover magnets 116 on floating ring 108 are positioned closer to upper lid cover magnets 126 on lid cover 128. This increases repulsion between the floating ring 108 and the lid cover 128 when the outer sleeve 102 (See FIG. 1) is raised. In addition, when floating ring 108 is raised, two mouth magnet platforms 120 are raised. Each of the mouth magnet platforms 120 has two mouth magnets 118, two positioned toward mouth 130 and two positioned toward the back of lid 110. Also in this raised position mouth cover 132 is moved backward to an open position with the use of the bar magnet component 134. When mouth magnets 118 are raised, the magnetic field forces the bar magnet component 134 back away from the mouth 130. When the user releases the handle 106 (See FIG. 1) or outer sleeve 102 (See FIG. 1) of container 100 (See FIG. 1), the outer sleeve 102 (See FIG. 1) returns to its resting position in conjunction with floating ring 108. Accordingly, mouth magnet platforms 120 along with the mouth magnets 118 return to their resting positions. When the mouth magnets 118 are released, the bar magnet component 134 is drawn back to its resting position permitting the mouth cover 132 to return to cover mouth 130.

Figure 6:
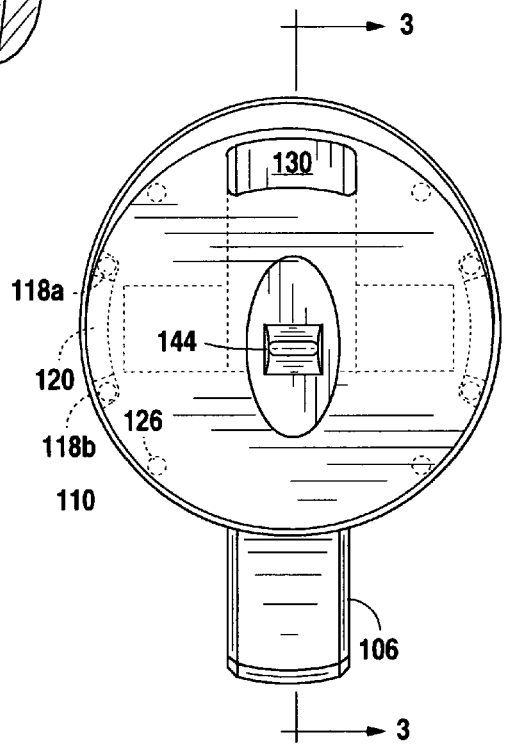
FIG. 6 is a top view of the preferred embodiment of the present invention.

FIG. 6 is a top view of the preferred embodiment of the present invention with handle 106. Lid 110 is shown with the locking mechanism 144 and mouth 130. Indicated underneath lid 110 are preferably two mouth magnet platforms 120. Each mouth magnet platform 120 has two mouth magnets

118*a* and 118*b*, mouth magnets 118*a* positioned toward mouth 130 and mouth magnets 118*b* positioned toward the back of lid 110. Upper lid cover magnets 126 are shown.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A self closing container comprising:

a receptacle;

an outer sleeve surrounding said receptacle wherein said outer sleeve is designed to move vertically in relation to said receptacle; and a lid comprising a ring positioned above said outer sleeve;

mouth magnet platforms positioned on opposing sides of said ring;

mouth magnets positioned on each said mouth magnet platforms;

a mouth platform with a mouth opening positioned above said ring;

a mouth cover positioned above said mouth platform;

a bar magnet component positioned at a base of said mouth cover; and a lid cover with a mouth opening positioned above said mouth platform.

2. The self closing container of claim 1 further comprising lid cover magnets positioned on said ring.

3. The self closing container of claim 1 further comprising a stopper positioned below said ring.

4. The self closing container of claim 1 further comprising a bar magnet tract positioned within said mouth platform.

5. The self closing container of claim 4 further comprising a lock notch positioned toward the back of said bar magnet tract.

6. The self closing container of claim 5 further comprising a lock tract extending toward the back of said lid away from said mouth opening.

7. The self closing container of claim 6 further comprising a mouth cover tract positioned behind mouth opening.

8. The self closing container of claim 1 wherein said mouth cover is composed of a tongue portion and a base portion.

9. The self closing container of claim 1 wherein said mouth cover is supported by a mouth cover base.

10. The self closing container of claim 1 further comprising a lower bar magnet tract positioned within said lid cover.

11. The self closing container of claim 10 further comprising a lower lock notch positioned toward the back of said lower bar magnet tract.

12. The self closing container of claim 2 further comprising upper lid cover magnets designed to repel said lid cover magnets.

13. The self closing container of claim 11 further comprising a lower lock tract extending toward the back of said lid away from said mouth opening.

14. The self closing container of claim 1 further comprising a locking mechanism positioned above said lid cover.

15. The self closing container of claim 14 wherein said locking mechanism further comprises a switch having a front depression and a rear depression.

16. The self closing container of claim 15 wherein said locking mechanism further comprises a raised portion positioned between said front depression and said rear depression.

17. The self closing container of claim 16 wherein said locking mechanism further comprises a bar positioned within said lock tract.

18. The self closing container of claim 17 wherein said locking mechanism further comprises a lock member positioned to the front of said bar.

19. The self closing container of claim 1 further comprising a means for moving said outer sleeve vertically in relation to said receptacle.

20. The self closing container of claim 19 wherein said means for moving said outer sleeve vertically in relation to said receptacle comprises a handle.

* * * * *